United States Patent [19]

Arrowsmith et al.

[11] Patent Number: 4,624,752

[45] Date of Patent: Nov. 25, 1986

[54] SURFACE PRETREATMENT OF ALUMINIUM AND ALUMINIUM ALLOYS PRIOR TO ADHESIVE BONDING, ELECTROPLATING OR PAINTING

[75] Inventors: David J. Arrowsmith, Edgbaston; Andrew W. Clifford, Weymouth, both of England

[73] Assignee: The Secretary of State for Defence in Her Brittanic Majesty's Government of the United Kingdom of Great Britian and Northern Ireland, London, England

[21] Appl. No.: 771,174

[22] Filed: Sep. 3, 1985

Related U.S. Application Data

[63] Continuation of Ser. No. 614,837, May 29, 1984, abandoned.

[30] Foreign Application Priority Data

Jun. 2, 1983 [GB] United Kingdom ..... 8315203

[51] Int. Cl.[4] ..... C25D 5/50

[52] U.S. Cl. ..... 204/37.6; 204/35.1; 204/33; 204/38.3; 204/38.7; 204/58

[58] Field of Search ..... 204/58, 33, 35.1, 37.6, 204/38.3, 38.7

[56] References Cited

U.S. PATENT DOCUMENTS

| | | | |
|---|---|---|---|
| 3,017,285 | 1/1962 | Wainer | 204/38.3 |
| 3,808,000 | 4/1974 | Magnotta | 96/35 |
| 4,116,695 | 9/1978 | Mori et al. | 101/459 |

FOREIGN PATENT DOCUMENTS

| | | | |
|---|---|---|---|
| 602858 | 6/1948 | United Kingdom | 204/37.6 |
| 1412004 | 10/1975 | United Kingdom | 204/37.6 |
| 1410768 | 10/1975 | United Kingdom | 204/37.6 |
| 1517746 | 7/1978 | United Kingdom | 204/37.6 |

OTHER PUBLICATIONS

"Hard Anodizing", Surface Treatment of Al, by Wernick et al, 1964, pp. 404–405, 415–416.

*Primary Examiner*—R. L. Andrews
*Attorney, Agent, or Firm*—William R. Hinds

[57] ABSTRACT

A method of surface pretreatment for aluminium or aluminium alloys before adhesive coating, electroplating or painting comprises a first anodizing step using an acid selected to produce a dense-packed, thick-walled anodic oxide coating followed by an etching step to modify the outer surface of the oxide coating while leaving the inner part unaffected.

The anodizing acid may be sulphuric acid or chromic acid and the etch acid may be phosphoric acid, chromic acid or a mixture of sulphuric and chromic acids.

16 Claims, No Drawings

SURFACE PRETREATMENT OF ALUMINIUM AND ALUMINIUM ALLOYS PRIOR TO ADHESIVE BONDING, ELECTROPLATING OR PAINTING

This application is a continuation, of application Ser. No. 614,837, filed May 29, 1984, now abandoned.

This invention relates to methods of improving adhesion to aluminium surfaces and to methods which give long term environmental stability of bonded aluminium. As used herein the word "aluminium" includes high purity aluminium, commercial purity aluminium and aluminium based alloys.

It is often desirable to coat aluminium with another material. These coatings may be organic coatings such as paint, lacquers, varnishes, or inorganic coatings such as vitreous enamel, glass, porcelain, magnetic ferrites, and refractory material. It is also often desirable to bond materials such as plastics, foams or metals to aluminium with organic adhesives. In all these applications it is desirable to treat the surface of the aluminium so that the coating material will adhere strongly to the aluminium.

Examples of important industrial applications include the structural bonding of metal to metal and composite type assembly widely used in the aircraft industry and increasingly used in the chemical engineering industry, in the automobile industry and in general engineering. Other examples include the powder painting of aluminium and the bonding of PTFE to aluminium to give low friction and non-stick surfaces.

Durability of the adhesive joint in service is important in most applications but particularly important in aircraft. Adhesively bonded joints in aircraft are exposed in service to a wide range of environmental conditions with extremes of temperature from the arctic to the tropical sun and in humid, marine and other highly corrosive environments. To avoid failures of the aircraft structures as well as to meet the stringent requirements of military aircraft standards and the standards established by the aircraft industry for commercial passenger and cargo aircraft, bonded metal to metal and composite type assemblies must be able to withstand the environmental conditions to be encountered. Of particular importance is resistance to corrosion and disbonding of adhesively bonded joints in humid environments especially those laden with salt from sea spray or from deicing materials. Failure of such joints frequently starts with diffusion of water through the adhesive followed by corrosion of the aluminium. To delay the onset of such corrosion, corrosion inhibitors may be incorporated in the adhesive or in a primer applied to the surface prior to the adhesive. Alternatively the aluminium may be pretreated in one of several ways. Various types of chemical conversion coatings (formed by processes such as chromating or phosphating) have been developed to give the pretreatment necessary for bonding to an aluminium substrate. Other pretreatments include anodizing to form relatively thick coatings of alumina. It is important that the alumina is not hydrated by water to form a weak layer of hydrated alumina which markedly reduces the strength of the joint and leads to premature failure. Hunter et al. (M. S. Hunter, P. F. Towner and D. L. Robinson, Proc. Amer. Electroplaters Soc 1959, 46, 220) compared the hydration rates of alumina formed in sulphuric, chromic, oxalic and phosphoric acids and found that the hydration rates of the first three were practically the same but alumina coatings formed in phosphoric acid hydrated at a slower rate than the others. They further found that alumina films that could be hydrated after boiling in water for about three minutes were not hydrated at all after boiling in dilute phosphoric acid or in a solution containing only nine parts per million of sodium dihydrogen orthophosphate.

The importance of this resistance to hydration was recognised by Marceau of the Boeing Aircraft Company who patented the use of phosphoric acid anodizing for providing environmentally stable aluminium surfaces for adhesive bonding (U.S. Pat. Nos. 4,085,012 and 4,127,451). This process is incorporated in the Boeing Process Specification BAC 5555.

The oxide film produced on aluminium by phosphoric acid anodizing (PAA) is rougher and has larger diameter pores than that produced by sulphuric acid anodizing (SAA). The outer surface of PAA aluminium has whisker-like spikes of alumina which interlock with adhesive to form a reinforced bond of high strength as shown by Venables et al. (J. D. Venables, D. K. McNamara, J. M. Chen, T. S. Sun and R. L. Hopping, Appl. Surface Science 1979, 3, 88). This structure is due to the solubility of alumina in phosphoric acid. Alumina is less soluble in sulphuric acid so the outer surface of SAA aluminium is smoother and has smaller diameter pores than PAA aluminium. Consequently, penetration of adhesive into the pores of SAA aluminium is restricted and the bond strength is poorer.

The disadvantage of using phosphoric acid is that it is about five times as expensive as sulphuric acid and it continues to dissolve the alumina after cessation of anodizing current encountered in commercial anodizing. Poor bonding results wherever the alumina surface is excessively dissolved. Rinsing/neutralising can prevent dissolution after anodising, however plants very often operate automatic systems. This usually means a drain time, and time for carriage from the anodising tank to the rinse tank of up to 1 min during which time dissolution can occur. The net result is a film which can be loose and weak in places with the protrusions partly removed.

It is an object of the invention to prepare adhesively bonded aluminium wherein the adhesive-aluminium interface exhibits environmental stability in an aqueous environment. It is a further object of this invention to provide a method of forming adhesively bonded aluminium in which adhesive failures at the aluminium-adhesive interface are minimized. It is a still further object of this invention to produce environmentally stable surfaces on aluminium for subsequent bonding to non-metallic materials, for electroplating and for painting.

The present invention comprises a method for producing environmentally stable surfaces on aluminium for adhesive bonding, electroplating or painting comprises the successive steps of:

(a) hard anodising the aluminum in sulphuric acid to produce a thick layer, which is environmentally stable and unaffected by the presence of water, of a dense-packed, thick-walled anodic coating (alumina), and (b) etching the anodised surface using phosphoric acid, the etch step conditions being within a range of times and temperatures such as to produce a textured surface suitable for bonding while leaving the inner part of the alumina coating unaffected, such that when a material is bonded to the aluminum the interface between them exhibits environmental stability and is not affected by the presence of water.

Also in accordance with the invention, a method for surface pretreatment of aluminum or aluminum alloy prior to bonding a material thereto comprises the successive steps of:

(a) hard anodising the aluminum in one or both acids selected from sulphuric acid and chromic acid such as to produce a thick layer which is environmentally stable and unaffected by the presence of water, of a dense-packed, thick-walled anodic coating (alumina), and (b) etching the anodised surface using an acid solution containing phosphate ions, the etch step conditions being within a range of times and temperatures such as to produce a textured surface suitable for bonding while leaving the inner part of the alumina coating unaffected, such that when a material is bonded to the aluminum the interface between them exhibits environmental stability and is not affected by the presence of water.

The present invention enables the use of, for example, sulphuric acid or chromic acid anodizing to prepare environmentally stable surfaces on aluminium for adhesive bonding which were hitherto not suitable as intermediate layers to improve bonding to aluminium. The aluminium is anodized in the acid under conditions that produce relatively thick dense coatings with very small diameter pores. These conditions favour corrosion resistance. Preferably sulphuric acid is used to anodize the aluminium but alternatively chromic acid may be used as chromic acid anodized surfaces may be etched as well as sulphuric acid anodized surfaces may be.

At this stage the outer surface of the alumina is not rough enough for adhesive bonding and the pores are too narrow for penetration by adhesive. The main feature of this invention is a controlled dip in a solution containing phosphoric acid in order to develop an outer surface of the alumina with a tailored topography for maximum reinforcement of the subsequent adhesive bond and distribution of the load on a stressed joint over a relatively thick interfacial region of alumina and adhesive. At the same time the inner part of the alumina remains dense and corrosion resistant, and furthermore the phosphoric acid renders the alumina hydration resistant. To produce the requisite surface topography, the processing parameters for both the sulphuric acid anodizing and the phosphoric acid dip have to be carefully selected.

Preferably the anodising solution is 10% sulphuric acid in deionised water at a temperature of approximately −5° C. Lead or stainless steel cathodes may be used and the anodising solution agitated by air. The processing time is preferably selected to produce a surface coating approximately 1–50 μm thick.

At this stage the surface of the anodic oxide coating is too flat for adhesive bonding, but by etching the oxide coating the surface becomes modified to a form suitable for adhesive bonding while at the same time retaining advantages arising from the sulphuric acid anodising process. After the anodising treatment the aluminium surface is stable and the anodised aluminium can be stored for long periods of time before the final acid etch treatment and bonding. Advantageously phosphoric acid is used for the etch treatment: preferably 25% phosphoric acid (85%) in deionised water. In the preferred method the aluminium is given a water rinse and is then air dried prior to long term storage and/or acid etching. Using 25% phosphoric acid at 60° C. the etch process is continued for one minute—the timing including the time to transfer to the water rinse. Alternatively the etching may be achieved using 10% phosphoric acid at 90° C. for one minute.

After said etching the aluminium is again water rinsed and air dried and advantageously the adhesive bonding, electroplating or painting is carried out within 72 hours.

Other acids may be used singly or in mixtures thereof for the anodising step providing they are capable of producing an anodic oxide film greater than about 15 Å/V ie a film thicker than a barrier layer.

The pretreatment of aluminium according to the invention is suitable not only in manufacturing industry but also for hand applications to localised areas and for repair systems.

In order that the invention may be more readily understood one example of the pretreatment of aluminium prior to adhesive bonding, electroplating or painting will now be given.

In order to prepare an aluminium object for adhesive bonding, painting or electroplating, the surface of the object is first degreased using a solvent: trichlorethylene vapour. After solvent cleaning the surface is then alkaline cleaned using a 10% solution of sodium hydroxide or a proprietary alkaline cleaner. The aluminium is then given a water rinse by immersion in tap water for 2–5 minutes.

After this cleaning the aluminium is anodised in sulphuric acid to form a surface anodic oxide coating approximately 40 μm thick. The aluminium is immersed in a 10% solution of sulphuric acid in deionised water at a temperature of −5° C. Lead or stainless steel cathodes are immersed in the electrolyte and a voltage of 24V is applied between the aluminium and the cathodes. At the same time the electrolyte is agitated by bubbling air through it. The anodising treatment is continued for 5–30 minutes. After anodising, the aluminium is rinsed by immersion in tap water for 2–5 minutes followed by a water spray. The anodised aluminium is then dried in warm air not exceeding about 60° C. At this stage the surface of the anodised aluminium is stable and not readily contaminated. The aluminium can therefore be stored for long periods prior to requirement for bonding or surface treatment.

Electron micrographs show that the anodised aluminium has a generally smooth outer surface which would not provide a suitable keying structure for the bonding of a primer or an adhesive.

The surface of the anodised aluminium is etched by treatment with 85% phosphoric acid made up to a 25% solution in deionised water. The anodised aluminium is immersed in the phosphoric acid at 60° C. for 1 minute and then the aluminium is rinsed by immersion in tap water for 2–5 minutes and then dried in warm air, not exceeding 60° C.

After acid etching of the anodised aluminium electron micrographs show that the surface layer of the anodic oxide coating comprises a plurality of needle-like projections, considered important for good bonding.

After the final etching step in the pretreatment process, the aluminium should be stored for no more than about 72 hours before application of a primer or an adhesive as is required to achieve maximum bond strength.

Applications of aluminium treated according to the invention include:

(a) adhesive bonding of aluminium alloys for air frames and cars etc;

(b) paint adhesion, particularly if corrosion resistance is important as in air frames;

(c) polymer adhesion, for example PTFE bearings on aluminium etc; and (d) electroplate adhesion.

The invention makes use of the hard, corrosion-resistant coating produced by acid anodising using an acid such as sulphuric acid, the coating being modified in such a way as to improve the ability of the anodic coating to bond to other materials.

It will be appreciated by those skilled in the art that modifications may be made to the example of the method of pretreatment described, all falling within the scope of the invention described in the specification. For example the treatment times and conditions for the anodising and etching processes may be varied from those specifically disclosed so as to produce a surface structure which is mechanically strong and corrosion resistant and provided with outward protrusions or needles, desirable for good bonding strength. Sulphuric acid has the advantage of cheapness and produces a structurally strong anodic coating, desirable as a substrate for paints, adhesives etc. By then modifying the outer surface of this anodic coating by acid etching, better bonding becomes possible. Phosphoric acid has a further advantage as the etching acid since it leaves a phosphonate coating as well and this has been shown to promote chemical bonding to the surface film. The amount of phosphoric acid used in the etching step is much less than would be required by conventional phosphoric acid anodising and is also used at a lower concentration. Other additives known in the art may be included in the etching process to further improve the bonding to the aluminium. Other acids which may be used singly or in a mixture thereof for the anodising step include oxalic, chromic and malonic acids.

We claim:

1. A method for surface pretreatment of aluminium or aluminum alloy prior to bonding a material thereto comprising the successive steps of:

(a) hard anodising the aluminum in sulphuric acid to produce a thick layer, which is environmentally stable and unaffected by the presence of water, of a dense-packed, thick-walled anodic coating (alumina), and (b) etching the anodised surface using phosphoric acid, the etch step conditions being within a range of times and temperatures such as to produce a textured surface suitable for bonding while leaving the inner part of the alumina coating unaffected, such that when a material is bonded to the aluminum the interface between them exhibits environmental stability and is not affected by the presence of water.

2. A method as claimed in claim 1 wherein the acid is 10% sulphuric acid in deionised water at a temperature of −5° C.

3. A method as claimed in claim 2 wherein the anodising step is timed to produce a surface coating in the thickness range 1–50 μm.

4. A method as claimed in claim 1 wherein the anodising acid is agitated by air.

5. A method as claimed in claim 1 wherein 25% phosphoric acid (85%) in deionised water is used.

6. A method as claimed in claim 5 wherein the acid is at 60° C. and the etching step lasts for one minute before rinsing in deionised water.

7. A method as claimed in claim 1 wherein the etch acid is a mixture of phosphoric acid and one or more other acids.

8. A method as claimed in claim 1 wherein the etch acid is a mixture of one or more acids and phosphate ions.

9. A method as claimed in claim 1 wherein 10% phosphoric acid is used.

10. A method as claimed in claim 9 wherein the acid is at 90° C. and the etching step lasts for 1 minute before rinsing in deionised water.

11. A method as claimed in claim 1 wherein the anodised aluminium is adhesively bonded, electroplated or painted within 72 hours of the etching step.

12. A method for surface pretreatment of aluminum or aluminum alloy prior to bonding a material thereto comprising the successive steps of:

(a) hard anodising the aluminum in one or both acids selected from sulphuric acid and chromic acid such as to produce a thick layer which is environmentally stable and unaffected by the presence of water, of a dense-packed, thick-walled anodic coating (alumina), and (b) etching the anodised surface using an acidic solution containing phosphate ions, the etch step conditions being within a range of times and temperatures such as to produce a textured surface suitable for bonding while leaving the inner part of the alumina coating unaffected, such that when a material is bonded to the aluminum the interface between them exhibits environmental stability and is not affected by the presence of water.

13. A method as claimed in claim 12 wherein the anodising acid is chromic acid.

14. A method as claimed in claim 12 wherein the anodising acid is sulphuric acid.

15. A method as claimed in claim 12 wherein the etching solution includes phosphoric acid.

16. A method as claimed in claim 15 wherein the etching solution is phosphoric acid.

* * * * *